US008196557B2

(12) United States Patent
Kameda et al.

(10) Patent No.: US 8,196,557 B2
(45) Date of Patent: Jun. 12, 2012

(54) PLASMA-JET SPARK PLUG AND IGNITION SYSTEM

(75) Inventors: Hiroyuki Kameda, Aichi-ken (JP); Yoshikuni Sato, Nagoya (JP); Daisuke Nakano, Kiyosu (JP); Naofumi Yamamura, Nagoya (JP); Daisuke Kasahara, Toyoake (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/038,442

(22) Filed: Mar. 2, 2011

(65) Prior Publication Data

US 2011/0221327 A1 Sep. 15, 2011

(30) Foreign Application Priority Data

Mar. 9, 2010 (JP) ..... 2010-051259
Feb. 24, 2011 (JP) ..... 2011-037820

(51) Int. Cl.
*F02P 23/00* (2006.01)
*F02P 21/04* (2006.01)

(52) U.S. Cl. ..... 123/143 B; 313/143

(58) Field of Classification Search ..... 123/143 B, 123/169 R, 144; 313/143
See application file for complete search history.

(56) References Cited

U.S. PATENT DOCUMENTS 4,369,756 A * 1/1983 Ezoe ..... 123/620
7,328,677 B2 * 2/2008 Hagiwara et al. ..... 123/143 B
7,827,954 B2 * 11/2010 Nagasawa et al. ..... 123/143 B
2006/0033411 A1 * 2/2006 Lindsay ..... 313/141
2007/0221156 A1 9/2007 Hagiwara et al. ..... 123/143
2007/0221157 A1 9/2007 Hagiwara et al. ..... 123/143
2008/0141967 A1 * 6/2008 Tani et al. ..... 123/143 B

FOREIGN PATENT DOCUMENTS

JP 2006-294257 10/2006
JP 2007-287666 11/2007

* cited by examiner

*Primary Examiner* — Erick Solis

(74) *Attorney, Agent, or Firm* — Kusner & Jaffe

(57) ABSTRACT

A plasma jet ignition plug including an insulator having an axial hole extending therethrough in the direction of an axis CL1, a center electrode inserted into the axial hole, and a ground electrode disposed frontward of the front end of the insulator. The insulator has a cavity defined by the wall surface of the axial hole and the front end surface of the center electrode and opens frontward. The ground electrode has a through hole for establishing communication between the cavity and an ambient atmosphere. A front end portion of the center electrode is formed into a taper portion whose diameter reduces frontward in the direction of the axis CL1. The outside diameter of a front end of the taper portion is smaller than the diameter of the through hole. The cavity has a substantially constant diameter with respect to the direction of the axis CL1.

15 Claims, 8 Drawing Sheets

PLASMA-JET SPARK PLUG AND IGNITION SYSTEM

FIELD OF THE INVENTION

The present invention relates to a plasma jet ignition plug for igniting an air-fuel mixture through formation of plasma and to an ignition system having the plasma jet ignition plug.

BACKGROUND OF THE INVENTION

Conventionally, a combustion apparatus, such as an internal combustion engine, uses a spark plug for igniting an air-fuel mixture through spark discharge. In recent years, in order to meet demand for high output and low fuel consumption, a plasma jet ignition plug has been proposed, since the plasma jet ignition plug provides quick propagation of combustion and can more reliably ignite even a lean air-fuel mixture having a higher ignition-limit air-fuel ratio.

Generally, the plasma jet ignition plug includes a tubular insulator having an axial hole, a center electrode inserted into the axial hole in such a manner that a front end surface thereof is located internally of a front end surface of the insulator, a metallic shell disposed externally of the outer circumference of the insulator, and an annular ground electrode joined to a front end portion of the metallic shell. Also, the plasma jet ignition plug has a space (cavity) defined by the front end surface of the center electrode and a wall surface of the axial hole. The cavity communicates with an ambient atmosphere via a through hole formed in the ground electrode.

Additionally, such the plasma jet ignition plug ignites an air-fuel mixture as follows. First, voltage is applied between the center electrode and the ground electrode, thereby generating spark discharge therebetween and thus causing dielectric breakdown therebetween. In this condition, high-energy current is applied between the center electrode and the ground electrode for effecting transition of a discharge state, thereby generating plasma within the cavity. The generated plasma is blown off through an opening of the cavity, thereby igniting the air-fuel mixture.

Meanwhile, according to a conceivable method for achieving enhanced ignition performance, current having higher energy is applied after generation of spark discharge for generating a larger plasma jet. However, when such high-energy current is applied, the center electrode becomes likely to erode, potentially resulting in an abrupt increase in voltage required for generation of spark discharge.

According to a known method for coping with the above problem (for example, see Japanese Patent Application Laid-Open (kokai) No. 2007-287666, hereinafter "Patent Document 1"), the wall of the cavity has a stepped shape for imparting a throttle to the cavity, whereby even when current having relatively low energy is applied, excellent ignition performance can be achieved. Also, according to a proposed technique (for example, see Japanese Patent Application Laid-Open (kokai) No. 2006-294257, hereinafter "Patent Document 2"), the axial length of the cavity is relatively long for increasing the blown-off velocity of plasma, whereby the blown-off length of flame is increased, thereby improving ignition performance.

However, in association with the phenomenon (so-called channeling) that spark discharge erodes a portion of the insulator located on a spark discharge path, the technique described in Patent Document 1 involves the following problem: since the wall of the cavity is curved (bent), the insulator is apt to be eroded at the curved (bent) portion. Further, since a spark discharge path which passes through an eroded portion of the insulator becomes shorter than other spark discharge paths, spark discharge is generated in a concentrated manner along the spark discharge path, causing local concentration of channeling. As a result, the insulator is eroded in a deep streaky manner. Thus, a groove lying on a line which connects the center electrode and a portion of the ground electrode located toward the outer circumference may be formed on the wall of the cavity. Spark discharge is generated along this groove. Even though plasma is generated, the plasma is less likely to be blown off outward due to the existence of the ground electrode. That is, according to the technique described in Patent Document 1, excellent ignition performance can be achieved at an early stage, but ignition performance may drastically deteriorate in the course of use.

Meanwhile, when, as in the case of the technique described in Patent Document 2, the axial length of the cavity is relatively long, the distance between the center electrode and the ground electrode becomes relatively long. Thus, a discharge voltage required for generation of spark discharge increases, causing rapid erosion of the center electrode and the insulator. As a result, ignition performance deteriorates rapidly, and difficulty may be encountered in generating spark discharges over a long period of time.

SUMMARY OF THE INVENTION

The present invention has been conceived in view of the above circumstances, and an object of the invention is to provide a plasma jet ignition plug capable of maintaining excellent ignition performance over a long period of time and an ignition system using the same.

Configurations suitable for achieving the above object will next be described in itemized form. If needed, actions and effects peculiar to the configurations will be described additionally.

Configuration 1: A plasma jet ignition plug of the present configuration comprises a tubular insulator having an axial hole extending therethrough in a direction of an axis; a rodlike center electrode inserted into the axial hole in such a manner that a front end thereof is located rearward of a front end of the insulator with respect to the direction of the axis; and a ground electrode disposed frontward of the front end of the insulator. The insulator has a cavity which is defined by a wall surface of the axial hole and a front end surface of the center electrode and opens frontward. The ground electrode has a through hole for establishing communication between the cavity and an ambient atmosphere. The plasma jet ignition plug is characterized in that: a front end portion of the center electrode is formed into a taper portion whose diameter reduces frontward with respect to the direction of the axis; an outside diameter of a front end of the taper portion is smaller than a diameter of the through hole; and a diameter of the cavity is substantially constant with respect to the direction of the axis, and the diameter DC (mm) of the cavity and a length LC (mm) of the cavity along the direction of the axis satisfy a dimensional relation $0.5 \leqq LC/DC < 1.0$.

The wall surface of the axial hole which partially defines the cavity may be inclined up to ±5° with respect to the axis. The shape of the cavity is not necessarily an exactly cylindrical shape (for example, the shape may be a frontward tapered shape). In the case where the wall surface of the axial hole which partially defines the cavity is inclined with respect to the axis, the "diameter of the cavity" means the average diameter of the cavity with respect to the direction of the axis.

According to the above configuration 1, the diameter DC of the cavity and the length LC of the cavity along the direction of the axis satisfy the dimensional relation $0.5 \leqq LC/DC < 1.0$.

That is, the cavity is shaped such that its length along a direction orthogonal to the axis is relatively long. Thus, as compared with the case where the axial length of the cavity is relatively long, the distance between the center electrode and the ground electrode can be reduced, whereby a discharge voltage required for generation of spark discharge can be reduced. As a result, erosion of the center electrode can be mitigated, whereby spark discharge and, in turn, plasma, can be generated over a longer period of time.

Meanwhile, when the length of the cavity along a direction orthogonal to the axis is increased, the blown-off velocity of plasma may be reduced. However, according to the above configuration 1, a front end portion of the center electrode is formed into a taper portion, and the outside diameter of the front end of the taper portion is smaller than the diameter of the through hole of the ground electrode. Therefore, at an early stage, spark discharge in the air (aerial discharge) can be actively generated between the front end of the taper portion and the wall surface of the through hole, and plasma can be generated without imposing restraint on propagation. As a result, a larger plasma jet can be generated, so that at the early stage, sufficient ignition performance can be achieved.

Also, since, at the early stage, aerial discharge is actively generated, the generation of spark discharge along the surface of the insulator (creeping discharge) is restrained to the greatest possible extent. Thus, coupled with the fact that the diameter of the cavity is substantially constant, erosion of the insulator and the generation of channeling can be more reliably prevented.

Additionally, as mentioned above, since erosion of the insulator is restrained, the radial expansion of the cavity is restrained. Thus, at a stage where the center electrode (taper portion) is eroded, the shape of the cavity can be such that the axial length is relatively long. Thus, the blown-off velocity of plasma can be increased with erosion of the center electrode. Therefore, even at a stage where erosion of the center electrode has progressed, excellent ignition performance can be achieved.

As mentioned above, according to the above configuration 1, erosion of the center electrode at an early stage is restrained, whereby plasma can be generated over a longer period of time. Also, not only at the early stage, but also even at a stage where erosion of the center electrode has progressed, excellent ignition performance can be achieved. That is, according to the above configuration 1, excellent ignition performance can be maintained over a very long period of time.

Configuration 2: A plasma jet ignition plug of the present configuration is characterized in that, in the above configuration 1, when SD1 (mm) represents the shortest distance between the wall surface of the through hole and the front end portion of the center electrode, and SD2 (mm) represents the shortest distance between the wall surface of the through hole and the center electrode as measured along the wall surface of the axial hole, with $0.3 \leqq SD1 \leqq 0.7$, the dimensional relation $1.1 \times SD1 < SD2$ is satisfied, with $0.7 < SD1 \leqq 1.0$, the dimensional relation $1.2 \times SD1 < SD2$ is satisfied, with $1.0 < SD1 \leqq 1.2$, the dimensional relation $1.3 \times SD1 < SD2$ is satisfied, and with $1.2 < SD1 \leqq 1.3$, the dimensional relation $1.4 \times SD1 < SD2$ is satisfied.

According to the above configuration 2, the shortest distance SD2 (i.e., the length of a discharge path when creeping discharge is generated) is sufficiently long in relation to the shortest distance SD1 (i.e., the length of a discharge path when aerial discharge is generated). Thus, at an early stage, aerial discharge can be generated more reliably. As a result, the actions and effects yielded by the above configuration 1 can be more reliably yielded.

When the shortest distance SD1 is less than 0.3 mm, the size of a plasma jet to be generated becomes relatively small, so that ignition performance at the early stage may deteriorate to some extent. When the shortest distance SD1 is in excess of 1.3 mm, in order to more reliably generate aerial discharge, the shortest distance SD2 must be increased excessively (i.e., the axial length of the taper portion must be increased excessively). Thus, there may arise a deterioration in strength of the center electrode against vibration and a deterioration in heat transfer of the center electrode in association with reduction in the contact area between the center electrode and the insulator (axial hole). In view of these points, preferably, the shortest distance SD1 is 0.3 mm to 1.3 mm inclusive.

Configuration 3: A plasma jet ignition plug of the present configuration is characterized by, in the above configuration 1 or 2, further comprising an annular recess which is formed between a front end surface of the insulator and a surface of the ground electrode located on a side toward the insulator and opens toward the axis, and characterized in that the dimensional relations $0.05 \leqq LG \leqq 0.5$ and $DG \leqq 1.1 \times LG$ are satisfied, where LG (mm) is the length of opening of the recess as measured along the axis, and DG (mm) is the shortest distance between the opening of the recess and an innermost portion of the recess as measured along the front end surface of the insulator.

According to the above configuration 3, the recess having a sufficiently large opening; specifically, an opening having a length of 0.05 mm or greater, is provided between the ground electrode and the front end surface of the insulator. That is, a relatively large gap is formed on a discharge path associated with creeping discharge which is generated along the wall surface of the axial hole between the center electrode and the wall surface of the through hole. Therefore, at an early stage, the generation of creeping discharge on the discharge path can be prevented more reliably.

Also, the shortest distance DG between the opening of the recess and the innermost portion of the recess (width of the recess) as measured along the front end surface of the insulator is set sufficiently long as compared with the length LG of the opening. Therefore, the generation of creeping discharge between the center electrode and the innermost portion of the recess can be prevented more reliably.

As mentioned above, according to the above configuration 3, at the early stage, the generation of creeping discharge can be effectively restrained, so that aerial discharge can be generated more reliably. Therefore, ignition performance at the early stage can be further improved.

Configuration 4: A plasma jet ignition plug of the present configuration is characterized in that, in any one of the above configurations 1 to 3, as viewed on a section which contains the axis, an angle of 15° or greater is formed between a straight line orthogonal to the axis and the shortest line segment which connects the wall surface of the through hole and the front end portion of the center electrode.

According to the above configuration 4, the angle between the shortest line segment and the straight line orthogonal to the axis is 15° or greater. That is, a direction along which aerial discharge is generated (a direction along which plasma is blown off) is determined so as not to approach a direction orthogonal to the axis. Therefore, plasma can be blown off vigorously from the through hole, so that the blown-off length of flame can be further increased. As a result, quite excellent ignition performance can be achieved.

Configuration 5: A plasma jet ignition plug of the present configuration is characterized in that, in any one of the above configurations 1 to 4, as viewed on a section which contains the axis, the taper portion of the center electrode and the wall surface of the cavity form an angle of 10° or greater.

According to the above configuration 5, when liquid, such as fuel, enters the cavity, a situation in which the liquid is held between the taper portion and the wall surface of the axial hole can be sufficiently restrained. Therefore, the generation of creeping discharge via the liquid can be restrained. Eventually, at an early stage, aerial discharge can be generated more reliably.

The greater the angle between the taper portion and the wall surface of the cavity, the greater the extent to which the liquid holding power can be weakened. Therefore, the angle is preferably 15° or greater, more preferably 20° or greater.

Configuration 6: A plasma jet ignition plug of the present configuration is characterized in that, in any one of the above configurations 1 to 5, the ground electrode has a thickness of 0.3 mm to 1.0 mm inclusive.

According to the above configuration 6, the ground electrode, which is disposed most frontward in the plasma jet ignition plug, has a thickness of 1.0 mm or less. Therefore, a deterioration in heat transfer in the ground electrode can be prevented more reliably, whereby erosion resistance of the ground electrode can be improved.

Meanwhile, the thickness of the ground electrode is specified to be 0.3 mm or greater. Therefore, allowance for erosion caused by spark discharge can be sufficiently provided, whereby spark discharge and plasma can be generated over a long period of time.

Configuration 7: A plasma jet ignition plug of the present configuration is characterized in the following: in any one of the above configurations 1 to 6, at least the front end portion of the center electrode is formed from tungsten (W) or a W alloy, and at least a portion of the ground electrode which forms the through hole is formed from an iridium (Ir) alloy or a platinum (Pt) alloy.

According to the above configuration 7, at least the front end portion of the center electrode is formed from W or a W alloy, and at least the portion of the ground electrode which forms the through hole is formed from an Ir alloy or a Pt alloy. Therefore, durability of the electrodes against spark discharge can be improved, and spark discharge and, in turn, plasma, can be generated over a longer period of time.

Configuration 8: An ignition system comprises a plasma jet ignition plug according to any one of the above configurations 1 to 7 and a plasma power supply for supplying power to the plasma jet ignition plug for generating plasma within the cavity. The ignition system is characterized in that the plasma power supply has an output of 10 mJ to 120 mJ inclusive.

The plasma jet ignition plug of any one of the above configurations 1 to 7can generate a large plasma jet through generation of aerial discharge. Thus, even when electric energy to be supplied from the plasma power supply to the plasma jet ignition plug is relatively low, the blown-off length of flame can be sufficiently long. Therefore, even though, as in the above configuration 8, the plasma power supply has a relatively low output of 10 mJ to 120 mJ inclusive, sufficient ignition performance can be achieved. Also, by virtue of employment of a relatively low output, erosion of the center electrode, etc. can be effectively restrained, so that spark discharge and, in turn, plasma, can be generated over a long period of time.

In order to generate plasma more reliably, preferably, the plasma power supply has an output of 10 mJ or greater.

Meanwhile, in view of reliable restraint of erosion of the center electrode, etc., reducing the output of the plasma power supply is preferred. Therefore, the output is preferably 10 mJ to 80 mJ inclusive, more preferably 10 mJ to 40 mJ inclusive.

Configuration 9: An ignition system of the present configuration is characterized in the following: in the above configuration 8, discharge voltage application means for applying voltage across a gap formed between the center electrode and the ground electrode is provided, and the plasma power supply is connected to an intermediate position between the plasma jet ignition plug and the discharge voltage application means, in parallel with the plasma jet ignition plug.

According to the above configuration 9, the plasma power supply is provided on a side toward the discharge voltage application means, in parallel with the plasma jet ignition plug. By means of an output voltage from the discharge voltage application means, output for generation of plasma (i.e., output of the plasma power supply) can be obtained. Therefore, the plasma power supply does not need to have a separate power unit or the like, whereby system size and manufacturing cost can be reduced.

In some cases, diodes are provided for preventing current flow from one of the discharge voltage application means and the plasma power supply to the other. However, the above configuration 9 does not require the provision of such diodes. Therefore, manufacturing cost can be further reduced.

Also, a configuration without provision of such diodes avoids the following problem: the existence of diodes restrains resonance of power supplied from the plasma power supply, causing deterioration in energy applied to the plasma jet ignition plug. Therefore, energy applied to the plasma jet ignition plug can be increased, whereby ignition performance can be further improved.

A capacitor, for example, can be used as the plasma power supply.

DETAILED DESCRIPTION OF THE INVENTION

Figure 1:
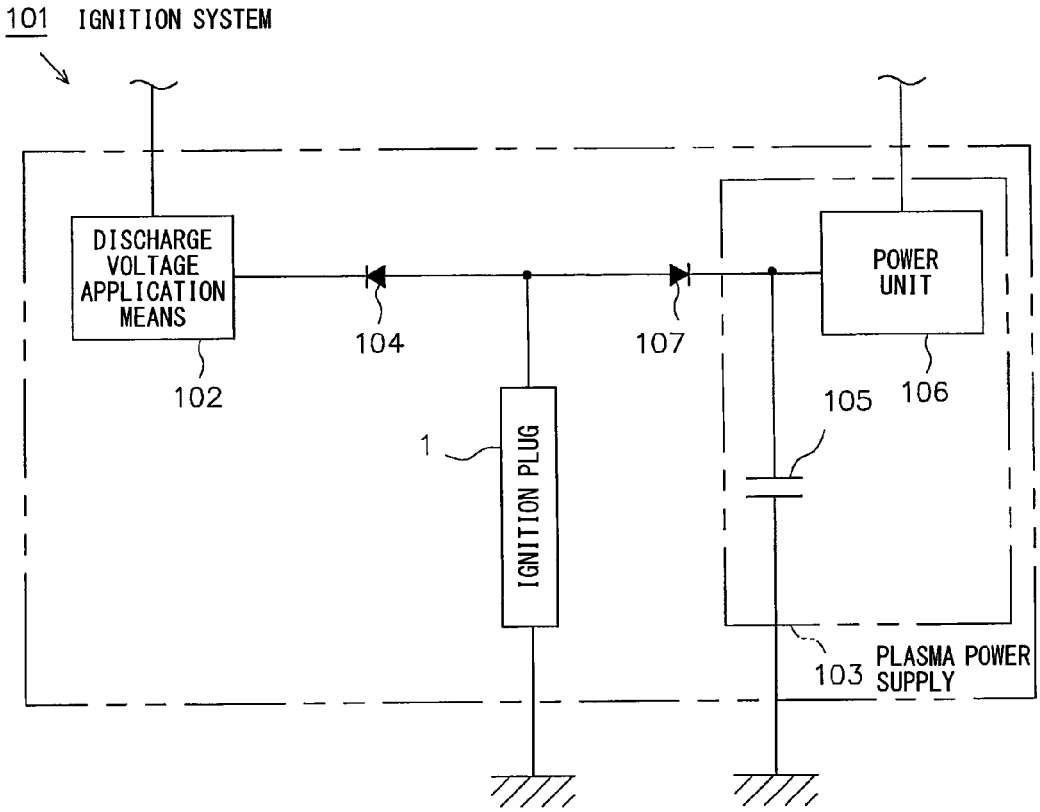
FIG. 1 is a block diagram showing the schematic configuration of an ignition system.

An embodiment of the present invention will next be described with reference to the drawings. FIG. 1 is a block diagram showing the schematic configuration of an ignition system 101 having a plasma jet ignition plug (hereinafter, referred to as the "ignition plug") 1. The ignition system 101 includes a discharge voltage application means 102 and a plasma power supply 103.

The discharge voltage application means 102 includes, for example, a CDI-type power supply circuit and is connected to the ignition plug 1 via a reverse current blocking diode 104. The discharge voltage application means 101 applies a high voltage to the ignition plug 1 for causing dielectric breakdown across the gap between a center electrode 5 and a ground electrode 27, which will be described later, of the ignition plug 1, thereby generating spark discharge; i.e., the discharge voltage application means 101 is adapted to generate trigger discharge. An unillustrated ECU (electronic control unit) controls timing etc. of trigger discharge.

The plasma power supply 103 includes a capacitor 105 for storing electric energy to be supplied to the ignition plug 1, and a power unit 106 for charging the capacitor 105. The capacitor 105 is grounded at one end and connected at the other end to the ignition plug 1 via a reverse current blocking diode 107 and is configured to allow charge and discharge. The electrostatic capacity of the capacitor 105 is determined such that the amount of energy to be supplied for a single generation of plasma (the sum of the amount of energy supplied for the trigger discharge and the amount of energy supplied from the capacitor 105) is 10 mJ to 120 mJ inclusive.

Figure 2:
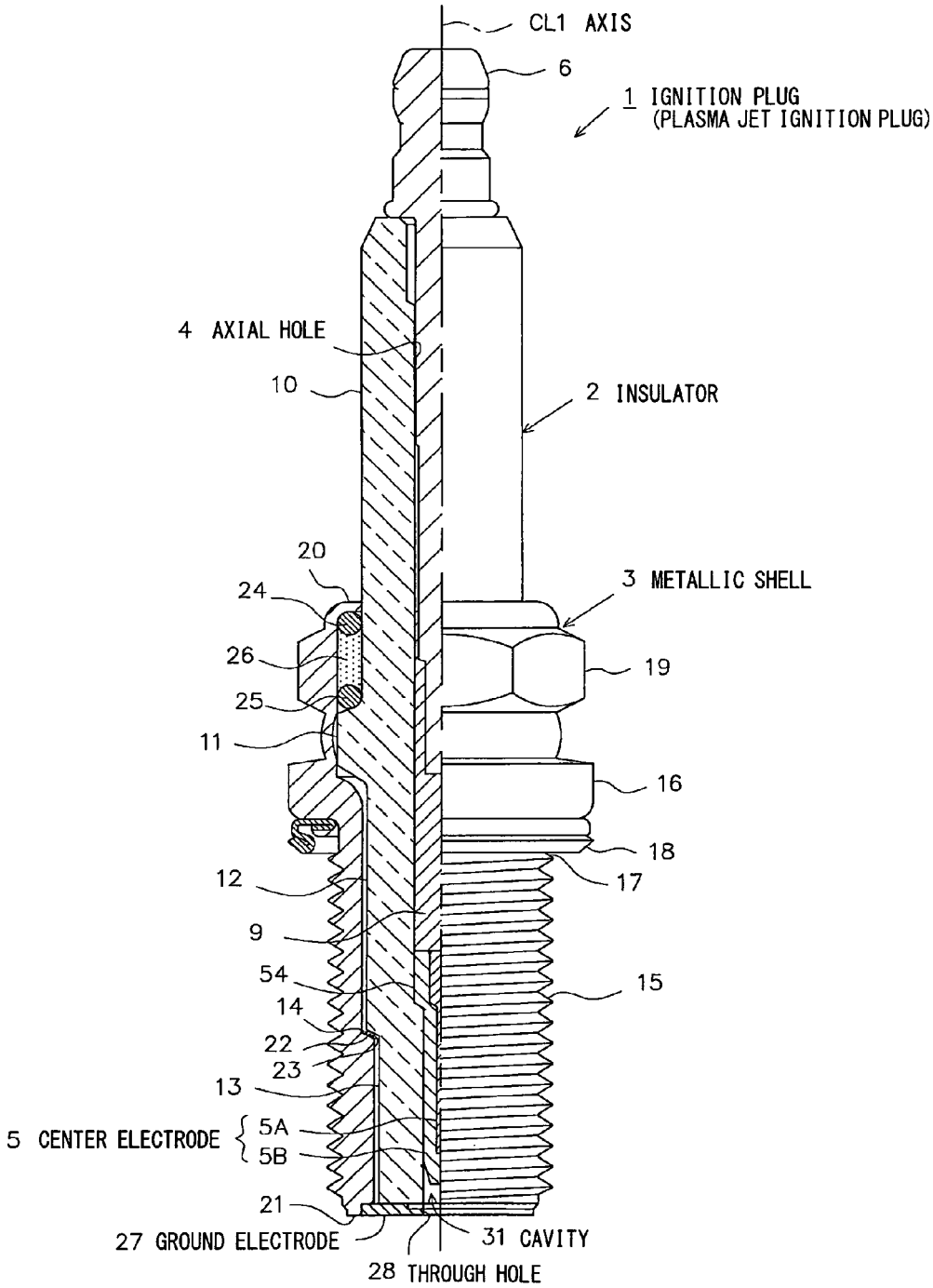
FIG. 2 is a partially cutaway front view showing the configuration of a plasma jet ignition plug.

Next, the configuration of the ignition plug 1 will be described in detail. FIG. 2 is a partially cutaway front view showing the ignition plug 1. In FIG. 2, the direction of an axis CL1 of the ignition plug 1 is referred to as the vertical direction. In the following description, the lower side of the spark plug 1 in FIG. 2 is referred to as the front side of the spark plug 1, and the upper side as the rear side.

The ignition plug 1 includes a tubular insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. Additionally, the large-diameter portion 11, the intermediate trunk portion 12, and the leg portion 13 of the insulator are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Further, the insulator 2 has an axial hole 4 extending therethrough along the axis CL1. A center electrode 5 is fixedly inserted into a front end portion of the axial hole 4. The center electrode 5 includes an inner layer 5A made of, for example, copper or a copper alloy, which has excellent thermal conductivity, and an outer layer 5B made of a nickel (Ni) alloy (e.g. INCONEL 600 or 610 (trade name)) which contains nickel as a main component. Further, the center electrode 5 assumes a rodlike (circular columnar) shape as a whole. The front end surface of the center electrode 5 is indented rearward of the front end surface of the insulator 2 (the constitution of a front end portion of the center electrode 5 will be described later in detail).

Also, a terminal electrode 6 is fixedly inserted into a rear end portion of the axial hole 4 and projects from the rear end of the insulator 2.

A circular columnar glass seal layer 9 is disposed within the axial hole 4 between the center electrode 5 and the terminal electrode 6. The center electrode 5 and the terminal electrode 6 are electrically connected together via the glass seal layer 9.

Additionally, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Further, the metallic shell 3 has, near the rear end thereof, a tool engagement portion 19 having a hexagonal cross section and allowing a tool, such as a wrench, to be engaged therewith when the ignition plug 1 is to be mounted to the combustion apparatus. Also, the metallic shell 3 has a crimp portion 20 provided at a rear end portion thereof for retaining the insulator 2. Further, the metallic shell 3 has an annular engagement portion 21 formed externally at a front end portion thereof and projecting frontward with respect to the direction of the axis CL1. The ground electrode 27, which will be described later, is joined to the engagement portion 21.

Also, the metallic shell 3 has, on its inner circumferential surface, a tapered, stepped portion 22 adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 22 of the metallic shell 3, a rear-end opening portion of the metallic shell 3 is crimped radially inward; i.e., the crimp portion 20 is formed, whereby the insulator 2 is fixed in place. An annular sheet packing 23 intervenes between the stepped portions 14 and 22 of the insulator 2 and the metallic shell 3, respectively. This retains gastightness of a combustion chamber and prevents outward leakage of fuel gas through a clearance between the leg portion 13 of the insulator 2 and the inner circumferential surface of the metallic shell 3.

Further, in order to ensure gastightness which is established by crimping, annular ring members 24 and 25 intervene between the metallic shell 3 and the insulator 2 in a region near the rear end of the metallic shell 3, and a space between the ring members 24 and 25 is filled with a powder of talc 26. That is, the metallic shell 3 holds the insulator 2 via the sheet packing 23, the ring members 24 and 25, and the talc 26.

The ground electrode 27 assumes the form of a disk and is formed from an Ni alloy which contains Ni as a main component. The ground electrode 27 is joined to a front end portion of the metallic shell 3 as follows: while the ground electrode 27 is engaged with the engagement portion 21 of the metallic shell 3, an outer circumferential portion of the ground electrode 27 is welded to the engagement portion 21. The ground electrode 27 is in surface contact with the front end surface of the insulator 2 and has a cylindrical through hole 28 which extends through a central portion thereof in the thickness direction. The wall surface of the axial hole 4 and the front end surface of the center electrode 5 define a cavity 31. The cavity 31 communicates with an ambient atmosphere via the through hole 28. The cavity 31 is a cylindrical space defined by the wall surface of the axial hole 4 and a plane which contains the front end of the center electrode 5 and is orthogonal to the axis CL1. In the present embodiment, the ground electrode 27 is joined such that the through hole 28 and the axial hole 4 are coaxial (i.e., the center of the through hole 28 is positioned on the axis CL1). Additionally, the diameter of the cavity 31 is substantially constant with respect to the direction of the axis CL1.

The shape of the cavity 31 is not necessarily an exactly cylindrical shape. Thus, for example, the cavity 31 may be shaped in such a manner as to be tapered frontward with respect to the direction of the axis CL1, and the wall surface of the axial hole 4 which partially defines the cavity 31 may be inclined up to ±5° with respect to the axis CL1. In this case, a diameter DC of the cavity 31, which will be described later, is the average of diameters measured at a plurality of positions located along the direction of the axis CL1 (for example, diameters measured at the front end and the rear end of the cavity 31).

Figure 3:
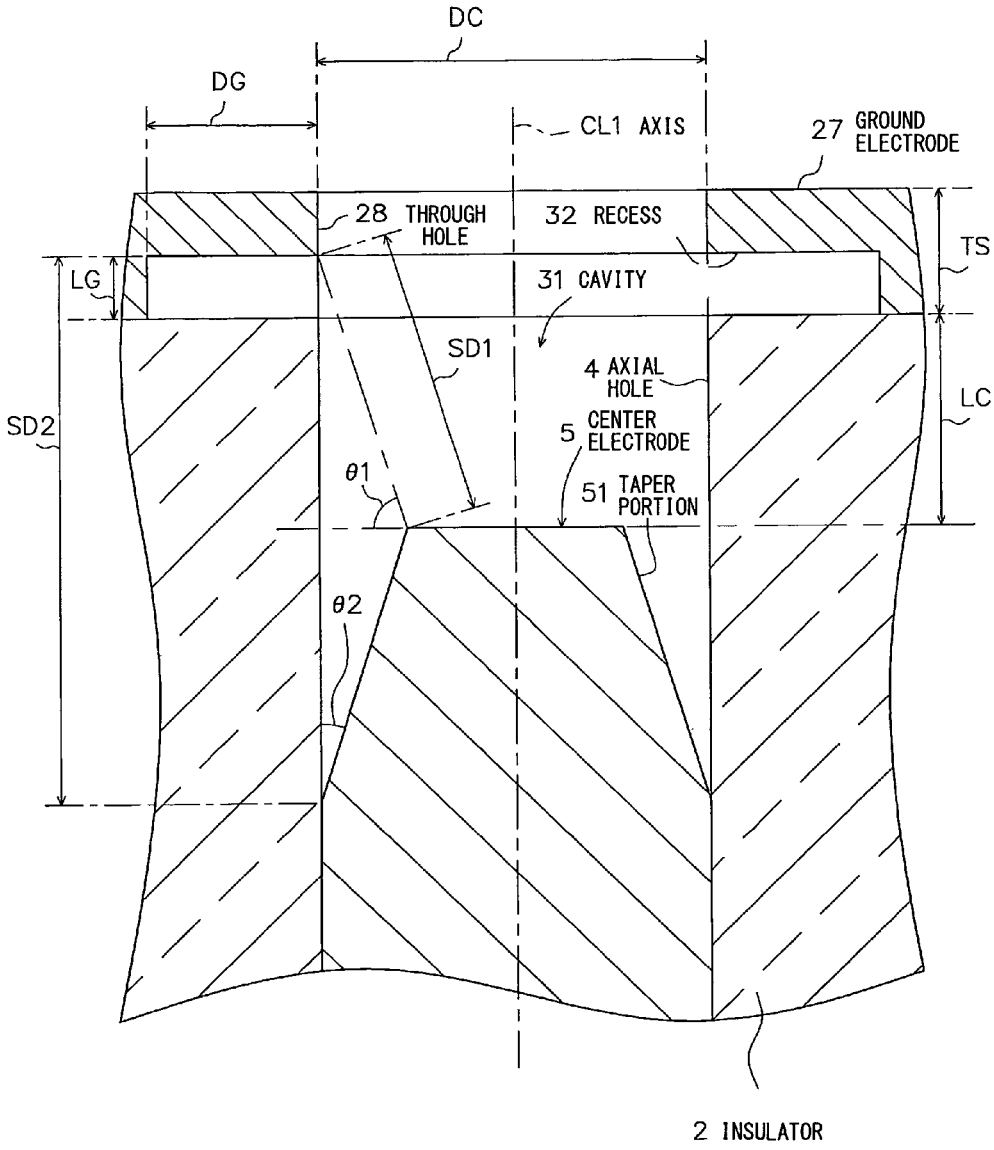
FIG. 3 is an enlarged sectional view showing the configuration of a front end portion of a center electrode, and its periphery.

Additionally, in the present embodiment, as shown in FIG. 3, a front end portion of the center electrode 5 is formed into a taper portion 51 which tapers frontward with respect to the direction of the axis CL1. The front end of the taper portion 51 has a relatively small diameter such that the outside diameter of the front end is smaller than the diameter of the through hole 28.

Further, the position of the front end portion of the center electrode 5 within the axial hole 4 is adjusted such that the length of the cavity 31 along a radial direction (the length measured orthogonally to the axis CL1) is longer than the length of the cavity 31 along the direction of the axis CL1. That is, when DC (mm) represents the diameter of the cavity 31, and LC (mm) represents the length of the cavity 31 along the direction of the axis CL1 (the distance along the axis CL1 between the opening of the axial hole 4 and the front end of the center electrode 5), the dimensional relation $0.5 \leqq LC/DC < 1.0$ is satisfied. In the present embodiment, the diameter DC is relatively small (e.g., 1.2 mm or less).

Additionally, in order to more efficiently generate plasma for achievement of sufficient ignition performance, a shortest distance SD1 (mm) between the wall surface of the through hole 28 and the front end portion (the taper portion 51) of the center electrode 5 is specified to be 0.3 mm to 1.3 mm inclusive (in the present embodiment, $0.7\ mm < SD1 \leqq 1.0\ mm$). The position of the rear end of the taper portion 51 along the direction of the axis CL1 is determined according to the shortest distance SD1. Specifically, when SD2 (mm) represents the shortest distance between the wall surface of the through hole 28 and the center electrode 5 (the rear end of the taper portion 51) as measured along the wall surface of the axial hole 4, the shortest distance SD2 is determined so as to satisfy the dimensional relation $1.2 \times SD1 < SD2$. In the present embodiment, the shortest distance SD2 is determined such that the length along the direction of the axis CL1 between the front end of the axial hole 4 and the rear end of the taper portion 51 is greater than the diameter of the cavity 31.

When the shortest distance SD1 is changed, preferably, the shortest distance SD2 is determined as follows. That is, preferably, when the shortest distance SD1 is 0.3 mm to 0.7 mm inclusive, the shortest distance SD2 is determined so as to satisfy the dimensional relation $1.1 \times SD1 < SD2$; when the shortest distance SD1 is in excess of 1.0 mm to 1.2 mm inclusive, the shortest distance SD2 is determined so as to satisfy the dimensional relation $1.3 \times SD1 < SD2$; and when the shortest distance SD1 is in excess of 1.2 mm to 1.3 mm inclusive, the shortest distance SD2 is determined so as to satisfy the dimensional relation $1.4 \times SD1 < SD2$.

Additionally, a recess 32 which is shaped annularly about the axis CL1 and opens toward the axis CL1 (the cavity 31) is formed between the front end surface of the insulator 2 and a surface of the ground electrode 27 located on a side toward the insulator 2. The recess 32 has a length LG (mm) of opening of 0.05 mm to 0.5 mm inclusive as measured along the axis CL1. The width of the recess 32; i.e., a shortest distance DG (mm) between the opening of the recess 32 and an innermost portion of the recess 32 as measured along the front end surface of the insulator 2, is determined so as to be sufficiently long as compared with the length LG of the recess 32. Specifically, the width of the recess 32 is determined so as to satisfy the dimensional relation $DG \geqq 1.1 \times LG$.

Further, in association with the phenomenon that aerial discharge between the center electrode 5 and the ground electrode 27 is likely to be generated across a gap where the electrodes 5 and 27 are closest to each other, the relative position between the wall surface of the through hole 28 and the front end portion of the center electrode 5 is adjusted so as to bring the direction of discharge closer to the direction of the axis CL1. That is, the relative position between the through hole 28 and the center electrode 5 is adjusted so as to establish the following: as viewed on a section which contains the axis CL1, an angle θ1 formed between a straight line orthogonal to the axis CL1 and the shortest line segment which connects the wall surface of the through hole 28 and the front end portion of the center electrode 5, and formed on a side toward the wall surface of the axial hole 4, is 15° or greater.

Also, in order for the side surface of the taper portion 51 to be sufficiently inclined with respect to the axis CL1, as viewed on a section which contains the axis CL1, an angle θ2 formed between the taper portion 51 and the wall surface of the cavity 31 (the axial hole 4) and formed on a front side with respect to the direction of the axis CL1 is specified to be 10° or greater.

Additionally, a thickness TS of the ground electrode 27 (excluding a portion where the recess 32 is formed) is rendered greater than the length LG of the recess 32 and specified to be 0.3 mm to 1.0 mm inclusive.

As described above in detail, according to the present embodiment, the diameter DC of the cavity 31 and the axial length LC of the cavity 31 satisfy the dimensional relation $0.5 \leqq LC/DC < 1.0$. Thus, as compared with the case where the axial length of the cavity 31 is relatively long, the distance between the center electrode 5 and the ground electrode 27 can be reduced, whereby a discharge voltage required for generation of spark discharge can be reduced. As a result, erosion of the center electrode 5 can be mitigated, whereby spark discharge and, in turn, plasma, can be generated over a longer period of time.

Meanwhile, when the length of the cavity 31 along a direction orthogonal to the axis CL1 is increased, the blown-off velocity of plasma may be reduced. However, according to the present embodiment, a front end portion of the center electrode 5 is formed into the taper portion 51, and the outside diameter of the front end of the taper portion 51 is smaller than the diameter of the through hole 28. Therefore, at an early stage, aerial discharge can be actively generated between the front end of the taper portion 51 and the wall surface of the through hole 28, and plasma can be generated without imposing restraint on propagation. As a result, a larger plasma jet can be generated, so that at the early stage, sufficient ignition performance can be achieved.

Also, since, at the early stage, aerial discharge is actively generated, the generation of creeping discharge along the surface of the insulator 2 is restrained to the greatest possible extent. Thus, coupled with the fact that the diameter of the cavity is substantially constant, erosion of the insulator 2 and the generation of channeling can be more reliably prevented.

Additionally, since erosion of the insulator 2 is restrained, the radial expansion of the cavity 31 is restrained. Thus, at a stage where the center electrode 5 (the taper portion 51) is eroded, the shape of the cavity 31 can be such that the axial length is relatively long. Thus, the blown-off velocity of plasma can be increased with erosion of the center electrode 5. Therefore, even at a stage where erosion of the center electrode 5 has progressed, excellent ignition performance can be achieved.

As mentioned above, according to the present embodiment, erosion of the center electrode 5 at an early stage is restrained, whereby plasma can be generated over a longer period of time. Also, not only at the early stage, but also even at a stage where erosion of the center electrode 5 has progressed, excellent ignition performance can be achieved. That is, according to the present embodiment, excellent ignition performance can be maintained over a very long period of time.

Also, the shortest distance SD2 is sufficiently long in relation to the shortest distance SD1. Thus, at an early stage, aerial discharge can be generated more reliably.

Additionally, the recess 32 having a length LG of 0.05 mm or greater and a width DG which is 1.1 times or greater the length LG is provided between the ground electrode 27 and the front end surface of the insulator 2. Therefore, at an early stage, the generation of creeping discharge can be prevented more reliably.

Further, the angle θ1 is specified to be 15° or greater; i.e., a direction along which aerial discharge is generated (a direction along which plasma is blown off) is determined so as to approach the direction of the axis CL1. Therefore, plasma can be blown off vigorously from the through hole 28, so that the blown-off length of flame can be further increased. As a result, quite excellent ignition performance can be achieved.

Also, since the angle θ2 is specified to be 10° or greater, when liquid, such as fuel, enters the cavity 31, a situation in which the liquid is held between the taper portion 51 and the wall surface of the axial hole 4 can be sufficiently restrained. By virtue of this, the generation of creeping discharge via the liquid can be restrained. Eventually, at an early stage, aerial discharge can be generated more reliably.

Also, since the ground electrode 27 has a thickness of 0.3 mm to 1.0 mm inclusive, durability of the ground electrode 27 can be sufficiently ensured.

Additionally, the ignition plug 1 can generate a large plasma jet through generation of aerial discharge. Thus, for improvement of ignition performance, there is no need to excessively increase electric energy. Therefore, as in the case of the present embodiment, electric energy to be supplied from the plasma power supply 103 to the ignition plug 1 can be relatively low. As a result, while sufficient ignition performance is achieved, erosion of the center electrode 5 etc. can be effectively restrained.

Figure 4A:
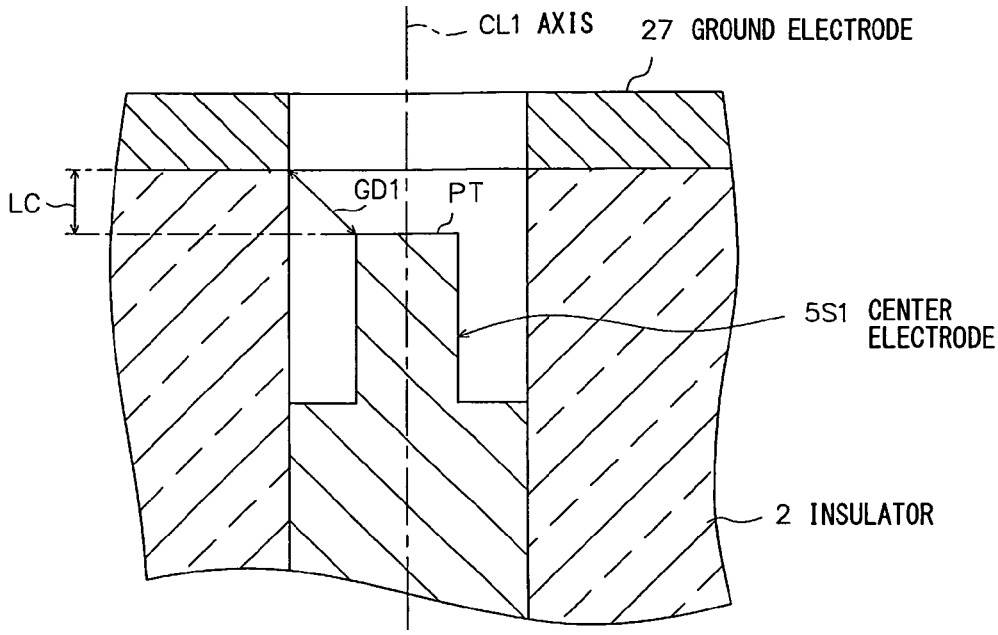
FIG. 4 shows a pair of fragmentary, enlarged, sectional views, wherein (a) shows the configuration of a center electrode and its periphery of a test sample of an ignition plug, and (b) shows the configuration of a center electrode and its periphery of a test sample of a conventional ignition plug.
Figure 4B:
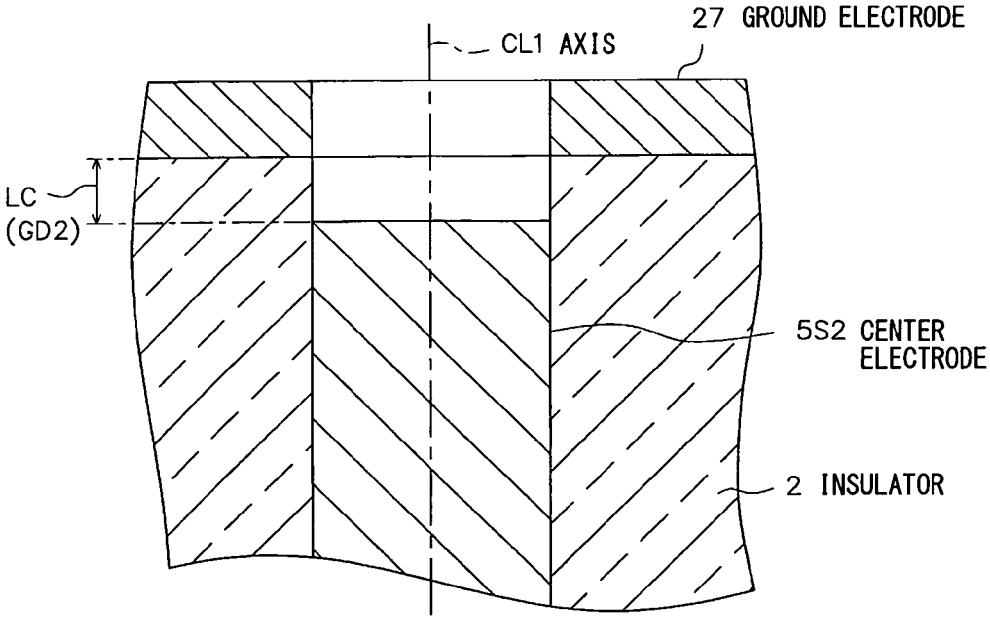

Next, an ignition performance evaluation test was conducted on conventional plasma jet ignition plugs for studying the effect of the ratio of the length LC (mm) of the cavity along the direction of the axis CL1 to the diameter DC (mm) of the cavity (LC/DC). Specifically, as shown in FIG. 4(*b*), in a conventional plasma jet ignition plug, a front end portion of a center electrode 5S2 has a circular columnar shape. Samples of the conventional plasma jet ignition plugs (conventional plug samples) having different LC/DC ratios were fabricated. Specifically, there were fabricated the conventional plug samples which have a length LC of the cavity of 0.5 mm as measured along the direction of the axis CL1 and differ in the diameter DC of the cavity, the conventional plug samples which have a length LC of 0.7 mm and differ in the diameter DC, and the conventional plug samples which have a length LC of 1.0 mm and differ in the diameter DC. The fabricated conventional plug samples were mounted to a 4-cylinder engine of 1.5 L displacement. The engine was operated at a speed of 1,600 rpm and a boost pressure of 320 mmHg. While the air-fuel ratio was being increased (the fuel content was being reduced), the variation percentage of engine torque was measured. An air-fuel ratio at which the variation percentage of engine torque exceeded 5% was obtained as a limit air-fuel ratio. The greater the limit air-fuel ratio, the better the ignition performance at an early stage.

Figure 5:
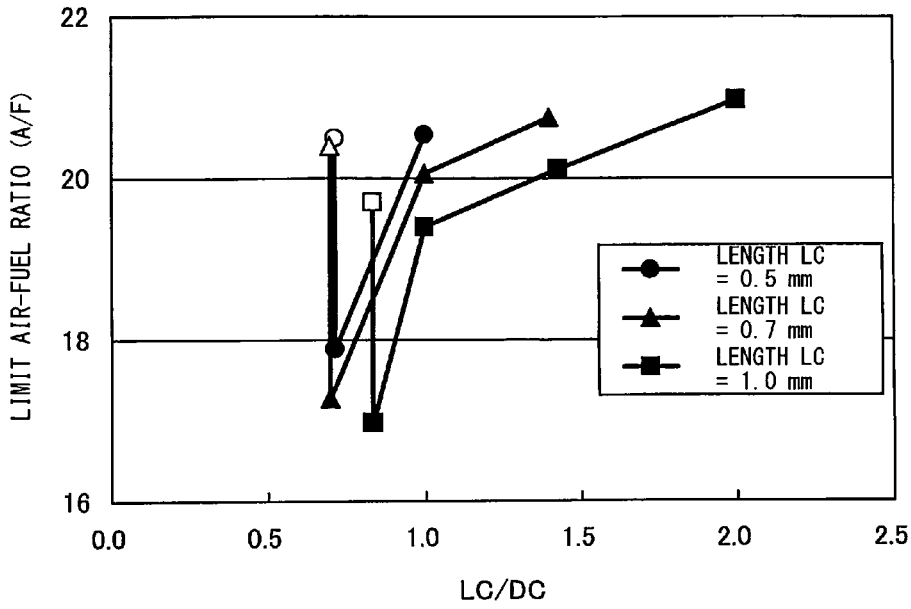
FIG. 5 is a graph showing the relation between LC/DC and the limit air-fuel ratio in conventional plug samples and invention samples.

FIG. 5 is a graph showing the relation between LC/DC and the limit air-fuel ratio. In FIG. 5, the test results of the samples having a length LC of 0.5 mm are plotted with circles; the test results of the samples having a length LC of 0.7 mm are plotted with triangles; and the test results of the samples having a length LC of 1.0 mm are plotted with squares. The test results of the conventional plug samples are plotted with solid black circles, triangles, and squares.

As shown in FIG. 5, the conventional plug samples having an LC/DC of less than 1.0 show a significant drop in limit air-fuel ratio, indicating deterioration in ignition performance at an early stage. Conceivably, this is for the following reason: as a result of LC/DC being less than 1.0, plasma is apt to radially expand, causing a reduction in the blown-off velocity of flame along the axial direction.

Next, the above-mentioned ignition performance evaluation test was conducted on samples of the plasma jet ignition plugs according to the embodiment of the present invention (invention samples). There were fabricated the invention samples which have a length LC of 0.5 mm, 0.7 mm, and 1.0 mm; whose cavities are shaped so as to have the LC/DC ratios which have caused a significant drop in limit air-fuel ratio in the conventional plug samples; and whose center electrodes have tapered front end portions; i.e., taper portions. In FIG. 5, the test results of the invention samples are shown with an outlined circle, an outlined triangle, and an outlined square.

As is apparent from FIG. 5, even though the invention samples have the LC/DC ratios which have caused a significant drop in limit air-fuel ratio in the conventional plug samples, the invention samples have excellent ignition performance. Conceivably, this is for the following reason: by virtue of the center electrode having a tapered front end portion; i.e., a taper portion, aerial discharge is easily generated between the taper portion and the ground electrode. As a result, a larger plasma jet is generated.

The above test results indicate that provision of a tapered front end portion; i.e., the taper portion, of the center electrode is significant, in terms of improvement of ignition performance at an early stage, for a plasma jet ignition plug which has the dimensional relation LC/DC≦1.0 and thus involves a potential deterioration in ignition performance at the early stage.

In the case of employment of the dimensional relation 0.5>LC/DC, it has been confirmed that the ignition plug according to the embodiment of the present invention has ignition performance superior to that of the conventional ignition plug, but may fail to achieve desired ignition performance. Therefore, in order to reliably achieve excellent ignition performance at the early stage, the dimensional relation $0.5 \leqq LC/DC$ is preferred.

Next, the following test was conducted in order to identify the relation between the shortest distances SD1 and SD2 at the time when aerial discharge between the taper portion and the wall surface of the through hole becomes more likely to be generated than is creeping discharge along the wall surface of the axial hole between the center electrode and the ground electrode.

Figure 6:
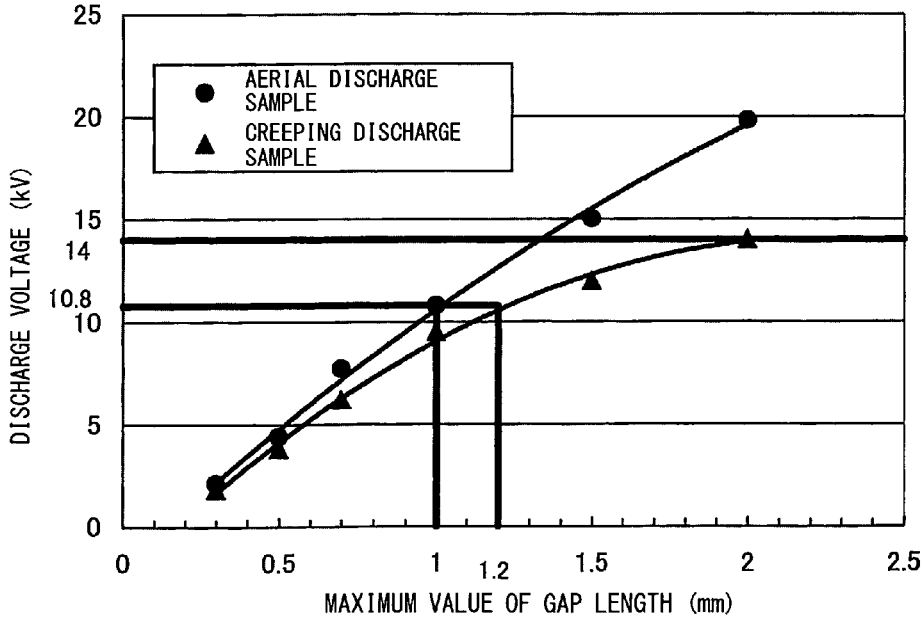
FIG. 6 is a graph showing the relation between a discharge voltage and the maximum gap length across which spark discharge is generated at the discharge voltage, in creeping discharge samples and aerial discharge samples.

First, there were fabricated a plurality of samples (aerial discharge samples) which have a center electrode 5S1 whose front end portion is formed into a circular columnar protrusion PT as shown in FIG. 4(*a*), and which differ in gap length GD1, as well as a plurality of samples (creeping discharge samples) which have a center electrode 5S2 having a circular columnar front end portion as shown in FIG. 4(*b*) and which differ in gap length GD2. In the aerial discharge samples, when voltage is applied, electric field intensity is relatively high, and aerial discharge is likely to be generated between the ground electrode 27 and the protrusion PT, which is located closest to the ground electrode. In the creeping discharge samples, when voltage is applied, creeping discharge is likely to be generated along the wall surface of the axial hole between the center electrode and the ground electrode. The samples were mounted to a predetermined chamber. While the chamber pressure was maintained at 0.4 MPa, the aerial discharge samples were measured for the discharge voltage at which aerial discharge was generated, and the creeping discharge samples were measured for the discharge voltage at which creeping discharge was generated. FIG. 6 is a graph showing the relation between the gap length and the discharge voltage in the samples. In FIG. 6, the discharge voltages of the aerial discharge samples are plotted with circles, and the discharge voltages of the creeping discharge samples are plotted with triangles. In the samples, the recess is not formed between the ground electrode and the insulator.

Figure 7:
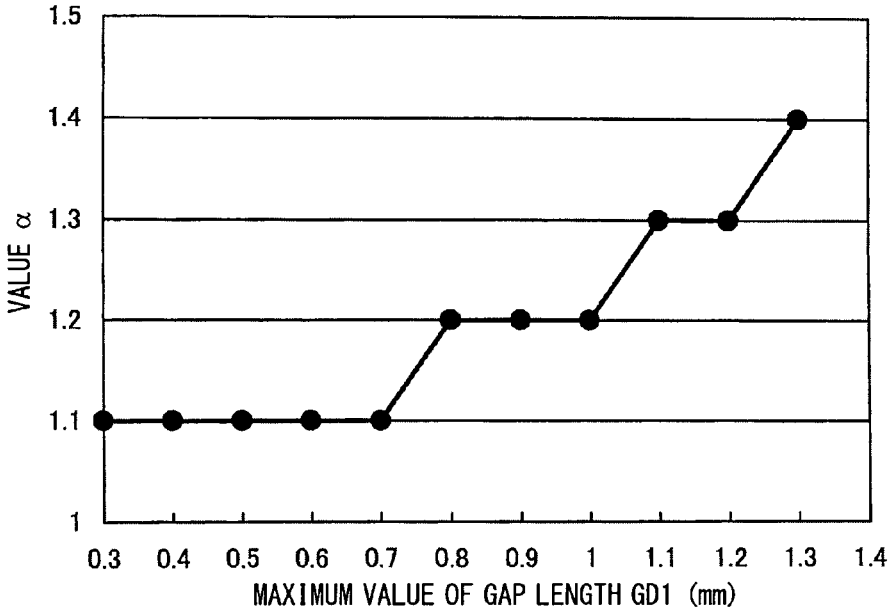
FIG. 7 is a graph showing a value $\alpha$ for the maximum value of gap length GD1, the product of the value $\alpha$ and the maximum value of the gap length GD1 across which aerial discharge is generated at a predetermined discharge voltage, being equal to or greater than the maximum value of gap length GD2 across which creeping discharge is generated at the predetermined discharge voltage.

On the basis of FIG. 6, the maximum value of the gap length GD1 at which aerial discharge was generated in an aerial discharge sample and the maximum value of the gap length GD2 at which creeping discharge was generated in a creeping discharge sample were obtained for each of applied discharge voltages. For example, when the discharge voltage is 10.8 kV, the maximum value of the gap length GD1 at which aerial discharge is generated in an aerial discharge sample is 1.0 mm, and the maximum value of the gap length GD2 at which creeping discharge is generated in a creeping discharge sample is 1.2 mm. Next, for each of the discharge voltages, the maximum value of the gap length GD2 is divided by the maximum value of the gap length GD1. The obtained quotient is rounded up to one decimal place, thereby yielding a value $\alpha$. When the value $\alpha$ obtained for a certain discharge voltage is multiplied by the maximum value of the gap length GD1 at the discharge voltage, the obtained value is equal to or greater than the maximum value of the gap length GD2 at the discharge voltage. In other words, by means of rendering the gap length GD2 greater than a value obtained by multiplying the value $\alpha$ at a predetermined discharge voltage by the maximum value of the gap length GD1 at the discharge voltage, when the discharge voltage is applied, aerial discharge is more likely to be generated than is creeping discharge. FIG. 7 shows the value $\alpha$ calculated for the maximum value of the gap length GD1.

As is apparent from FIG. 7, when the maximum value of the gap length GD1 is 0.3 mm to 0.7 mm inclusive, by multiplying the maximum value of the gap length GD1 by 1.1, the obtained value is greater than the maximum value of the gap length GD2 at which creeping discharge is generated. Also, when the maximum value of the gap length GD1 is in excess of 0.7 mm to 1.0 mm inclusive, by multiplying the maximum value by 1.2; when the maximum value of the gap length GD1 is in excess of 1.0 mm to 1.2 mm inclusive, by multiplying the maximum value by 1.3; and when the maximum value of the gap length GD1 is in excess of 1.3 mm, by multiplying the maximum value by 1.4, the obtained values are greater than the corresponding maximum values of the gap length GD2 at which creeping discharge is generated.

In view of the above test results, in the case where a front end portion of the center electrode is formed into the taper portion, for easier generation of aerial discharge than generation of creeping discharge, preferably, with $0.3 \leqq SD1 \leqq 0.7$, the shortest distance SD1 and the shortest distance SD2 satisfy the dimensional relation $1.1 \times SD1 < SD2$; with $0.7 < SD1 \leqq 1.0$, SD1 and SD2 satisfy the dimensional relation $1.2 \times SD1 < SD2$; with $1.0 < SD1 \leqq 1.2$, SD1 and SD2 satisfy the dimensional relation $1.3 \times SD1 < SD2$; and with $1.2 < SD1 \leqq 1.3$, SD1 and SD2 satisfy the dimensional relation $1.4 \times SD1 < SD2$. It may be said that, through satisfaction of the above dimensional relations, ignition performance at an early stage can be further improved.

As shown in FIG. 6, in the case of a gap length GD1 in excess of 1.3 mm, for easier generation of aerial discharge than generation of creeping discharge, the gap length GD2 must be increased excessively (for example, in the case of a discharge voltage of 14 kV, the gap length GD2 must be 2.5 mm or greater). In this case, the taper portion becomes excessively long along the axial direction. As a result, there may arise a deterioration in heat transfer of the center electrode, a deterioration in strength of the center electrode against vibration, and a like problem. Therefore, preferably, the shortest distance SD1 is 1.3 mm or less.

Next, there were fabricated ignition plug samples which have an SD2/SD1 of 1.1 or 1.4 and are provided with the recess and which differ in the length LG of opening of the recess. The samples were mounted to a predetermined chamber. While the chamber pressure was held at 0.4 MPa, discharge voltage was applied a plurality of times, and the incidence of aerial discharge (aerial discharge rate) was measured.

Further, ignition plug samples which have an SD2/SD1 of 1.1 to 1.4 and are not provided with the recess were measured for a flame area S0 by laterally observing blown-off flames. Similarly, ignition plug samples which have an SD2/SD1 of 1.1 to 1.4 and are provided with the recess and which differ in the length LG of opening of the recess were measured for a flame area SF. The percentage of the flame area SF to the flame area S0 (SF/S0; hereinafter, referred to as the flame area percentage) was obtained.

Figure 8:
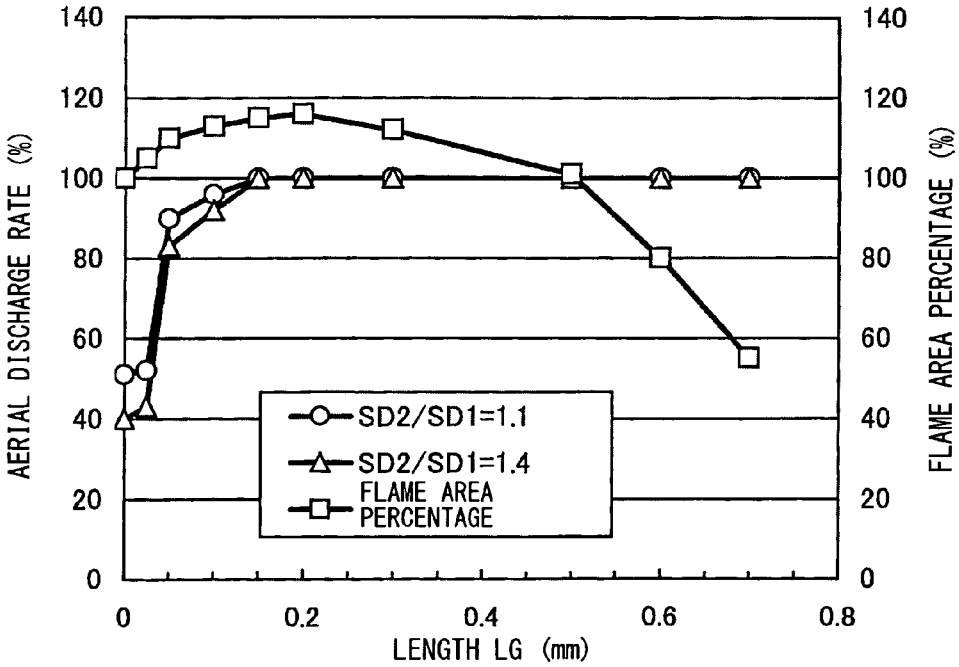
FIG. 8 is a graph showing aerial discharge rates and flame area percentages of those samples which differ in length LG.

FIG. 8 is a graph showing the relation of the length LG to the aerial discharge rate and the flame area percentage. In FIG. 8, the aerial discharge rates of the samples having an SD2/SD1 of 1.1 are plotted with circles, and the aerial discharge rates of the samples having an SD2/SD1 of 1.4 are plotted with triangles. Also, the flame area percentages are plotted with squares. The samples have a sufficiently large width DG of the recess of 1.0 mm.

As shown in FIG. 8, the samples having a length LG of opening of the recess of 0.05 mm or greater exhibit a great increase in aerial discharge rate. Conceivably, this is for the following reason. Since a sufficiently large length LG of 0.05 mm or greater is employed, a relatively large space (gap) is formed on a route which extends along the wall surface of the axial hole between the ground electrode and the wall surface of the through hole. Thus, a discharge voltage required for generation of aerial discharge is usually higher than that required for generation of creeping discharge, but the discharge voltage required for generation of creeping discharge along the route increases to an extent corresponding to the space. As a result, creeping discharge is less likely to be generated, whereas aerial discharge is more likely to be generated.

Also, the test data concerning the flame area percentage indicate that through provision of the recess, the size of a blown-off flame can be increased. Conceivably, this is for the following reason. By virtue of provision of the recess, transfer of heat of flame to the ground electrode can be reliably restrained.

Meanwhile, the samples having a length LG of opening of the recess in excess of 0.5 mm show a reduction in the size of a blown-off flame. Conceivably, this is for the following reason. As a result of excessive expansion of opening of the recess, flame enters the recess and is thus less likely to be blown off from the through hole.

As can be understood from the above test results, in view of easier generation of aerial discharge and an increase in the size of a blown-off flame for further improvement of ignition performance, preferably, the recess is provided between the insulator and the ground electrode, and the length LG of opening of the recess is 0.05 mm to 0.5 mm inclusive. For far easier generation of aerial discharge and a further increase in the size of a blown-off flame, more preferably, the length LG is 0.15 mm or greater.

When the width of the recess is excessively small, creeping discharge is generated along the surface of the insulator between the center electrode and an innermost portion of the recess, potentially resulting in insufficient ignition performance. In view of this point, as shown in FIG. 7, in the case of a maximum value of the gap length GD1 of 0.7 mm or less, in order to restrain generation of creeping discharge, it is good practice for the gap length GD2 (creepage distance) to be 1.1 times or greater the gap length GD1. Therefore, assuming that the length LG of opening of the recess corresponds to the gap length GD1, the following can be said: in the case of a length LG of 0.5 mm or less, by means of the width of the recess (the shortest distance DG between the front end of the axial hole and the innermost portion of the recess as measured along the surface of the insulator) being 1.1 times or greater the length LG, the generation of creeping discharge between the center electrode and the innermost portion of the recess can be restrained. Thus, in view of prevention of deterioration in ignition performance, preferably, the shortest distance DG (mm) is determined so as to satisfy the dimensional relation $DG \leqq 1.1 \times LG$.

Figure 9:
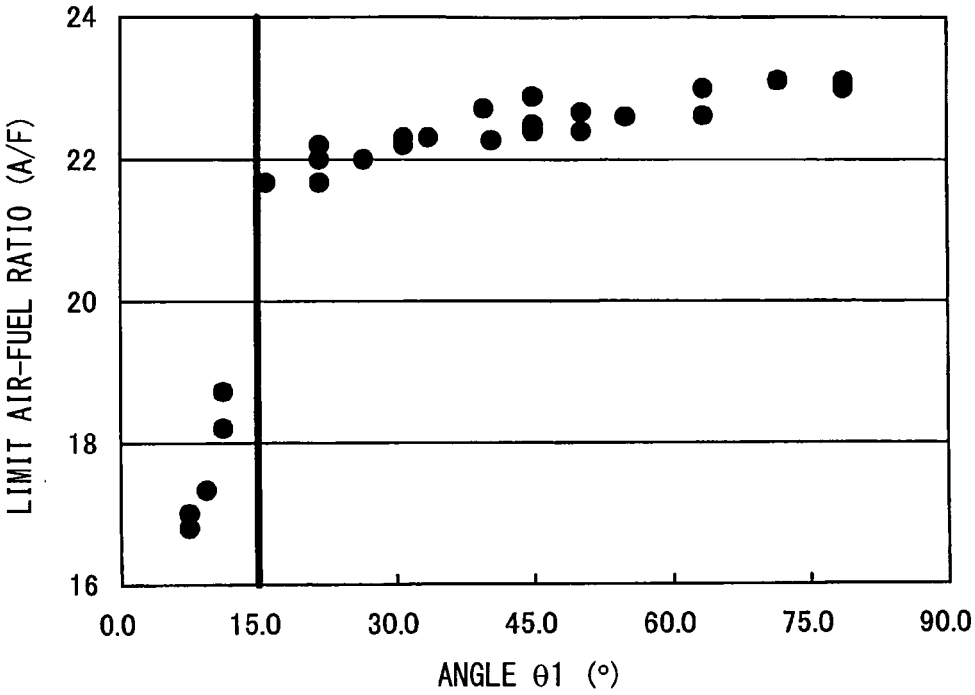
FIG. 9 is a graph showing the results of an ignition performance evaluation test conducted on samples which differ in angle θ1.

Next, ignition plug samples which differ in the angle θ1 were fabricated. The aforementioned ignition performance evaluation test was conducted on the samples. FIG. 9 shows the results of the test.

As is apparent from FIG. 9, as compared with the samples having an angle θ1 of less than 15°, the samples having an angle θ1 of 15° or greater exhibit a marked improvement in ignition performance. Conceivably, this is for the following reason: by means of the angle θ1 being 15° or greater, the direction of spark discharge can be brought closer to the direction of the axis CL1, and, in turn, flame can be smoothly blown off outward.

As can be understood from the above test results, in order to further improve ignition performance, preferably, the angle θ1 is 15° or greater.

Next, ignition plug samples which differ in the angle θ2 were fabricated. A bridge check test was conducted on the samples. The outline of the bridge check test is as follows. The prepared test machine includes a pendulum and a support, which supports the pendulum and extends in the vertical direction. The cavities of the samples were filled with colored water. Each of the samples was attached to a distal end portion of the pendulum. The pendulum was moved away from the support by 15° and was then released for free fall so as to hit the sample against the support, thereby shaking off water from the cavity. Subsequently, the sample was checked whether or not a bridge of water was present between the taper portion and the wall surface of the axial hole. The samples which were found to have no bridge were evaluated as "Good," indicating the following: even when fuel or the like enters the cavity, a bridge of fluid is unlikely to be formed between the taper portion and the wall surface of the axial hole, so that the generation of creeping discharge can be more reliably restrained. The samples which were found to have a bridge were evaluated as "Fair," indicating that when fuel or the like enters the cavity, creeping discharge is apt to be generated to some extent. Table 1 shows the results of the bridge check test.

TABLE 1

| Angle θ2 | Evaluation |
|---|---|
| 8° | Fair |
| 9° | Fair |
| 10° | Good |
| 12° | Good |
| 15° | Good |
| 20° | Good |
| 25° | Good |

As is apparent from Table 1, in the samples having an angle θ2 of 10° or greater, the existence of a bridge was not found. Thus, even when fuel or the like enters the cavity, the generation of creeping discharge can be reliably restrained. Conceivably, this is for the following reason: by means of the angle θ2 being 10° or greater, the force of holding liquid between the taper portion and the wall surface of the axial hole has reduced sufficiently.

As can be understood from the above test results, preferably, in order to prevent the generation of creeping discharge associated with entry of fuel or the like into the cavity, the angle θ2 is 10° or greater.

The present invention is not limited to the above-described embodiment, but may be embodied, for example, as follows. Of course, applications and modifications other than those exemplified below are also possible.

Figure 10:
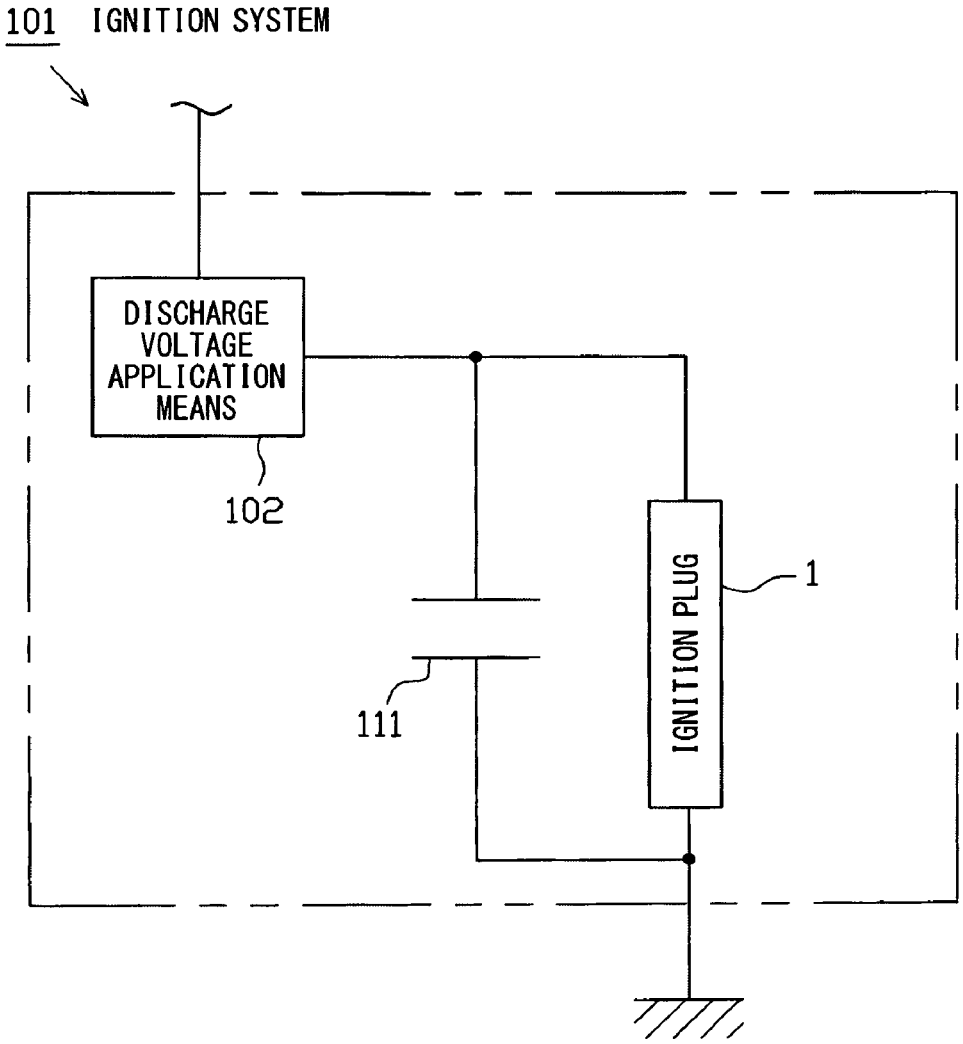
FIG. 10 is a block diagram showing the schematic configuration of an ignition system according to another embodiment of the present invention.

(a) In the above embodiment, the plasma power supply 103 includes the capacitor 105 and the power unit 106. However, as shown in FIG. 10, the plasma power supply may be configured such that a capacitor 111 is connected to an intermediate position between the ignition plug 1 and the discharge voltage application means 102, in parallel with the ignition plug 1. In this case, an output voltage from the discharge voltage application means 102 can be used as output for generation of plasma (i.e., the output voltage is used to charge the capacitor 111). Therefore, there is no need to provide the power unit 106, whereby system size and manufacturing cost can be reduced.

Additionally, in the above embodiment, the diodes 104 and 107 are provided for preventing current flow from one of the discharge voltage application means 102 and the plasma power supply 103 to the other. However, there is no need to provide such diodes. Therefore, manufacturing cost can be further reduced.

Also, a configuration without provision of such diodes avoids the following problem: the existence of diodes restrains resonance of power supplied from the plasma power supply, causing deterioration in power applied to the plasma jet ignition plug 1. Therefore, power applied to the plasma jet ignition plug 1 can be increased, whereby ignition performance can be further improved.

(b) In the above embodiment, a front end portion of the center electrode 5 (the outer layer 5B) is formed from an Ni alloy. However, for example, by means of joining an electrode tip of tungsten (W) or a W alloy to a front end portion of the center electrode 5, at least the front end portion of the center electrode 5 may be formed from W or a W alloy. In this case, erosion resistance of the front end portion of the center electrode 5 can be improved, whereby spark discharge and, in turn, plasma, can be generated over a long period of time.

(c) In the above embodiment, the ground electrode 27 is formed from an Ni alloy. However, at least a portion of the ground electrode 27 which forms the through hole 28 may be formed from an iridium alloy or a platinum alloy. In this case, sufficiently improved erosion resistance can be imparted to the portion of the ground electrode 27 which forms the through hole 28; i.e., a portion of the ground electrode 27 which is otherwise particularly likely to be eroded in association with generation of spark discharge and plasma.

(d) In the above embodiment, the ground electrode 27 is in contact with the front end surface of the insulator 2. However, the ground electrode 27 and the front end surface of the insulator 2 may not be in contact with each other; i.e., some clearance may be provided therebetween. However, in view of heat resistance of the ground electrode 27, preferably, the ground electrode 27 is in contact with the insulator 2.

(e) In the above embodiment, the front end of the center electrode 5 is flat. However, for example, the front end may be convexly curved.

(f) In the above embodiment, the through hole 28 and the axial hole 4 are coaxial (i.e., the center of the through hole 28 is positioned on the axis CL1). However, the center of the through hole 28 may be deviated to some extent from the axis CL1.

(g) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

| Description of Reference Numerals | |
|---|---|
| 1: | plasma jet ignition plug; |
| 2: | insulator; |
| 4: | axial hole; |
| 5: | center electrode; |
| 27: | ground electrode; |
| 28: | through hole; |
| 31: | cavity; |
| 32: | recess; |
| 51: | taper portion; |
| 101: | ignition system; |
| 102: | discharge voltage application means; |
| 103: | plasma power supply; and |
| CL1: | axis. |

Having described the invention, the following is claimed:

1. A plasma jet ignition plug comprising:

a tubular insulator having an axial hole extending therethrough in a direction of an axis;

a rodlike center electrode inserted into the axial hole in such a manner that a front end thereof is located rearward of a front end of the insulator with respect to the direction of the axis; and a ground electrode disposed frontward of the front end of the insulator;

wherein the insulator has a cavity which is defined by a wall surface of the axial hole and a front end surface of the center electrode and opens frontward, and the ground electrode has a through hole for establishing communication between the cavity and an ambient atmosphere; and wherein a front end portion of the center electrode is formed into a taper portion whose diameter reduces frontward with respect to the direction of the axis;

an outside diameter of a front end of the taper portion is smaller than a diameter of the through hole; and a diameter of the cavity is substantially constant with respect to the direction of the axis, and the diameter DC (mm) of the cavity and a length LC (mm) of the cavity along the direction of the axis satisfy a dimensional relation $0.5 \leqq LC/DC < 1.0$.

2. A plasma jet ignition plug according to claim 1, wherein when the through hole and the center electrode are disposed such that a wall surface of the through hole and the front end portion of the center electrode have a shortest distance SD1 (mm) therebetween, and the wall surface of the through hole and the center electrode have a shortest distance SD2 (mm) therebetween as measured along the wall surface of the axial hole, with $0.3 \leqq SD1 \leqq 0.7$, a dimensional relation $1.1 \times SD1 < SD2$ is satisfied, with $0.7 < SD1 \leqq 1.0$, a dimensional relation $1.2 \times SD1 < SD2$ is satisfied, with $1.0 < SD1 \leqq 1.2$, a dimensional relation $1.3 \times SD1 < SD2$ is satisfied, and with $1.2 < SD1 \leqq 1.3$, a dimensional relation $1.4 \times SD1 < SD2$ is satisfied.

3. A plasma jet ignition plug according to claim 1, further comprising an annular recess which is formed between a front end surface of the insulator and a surface of the ground electrode located on a side toward the insulator and opens toward the axis, wherein dimensional relations $0.05 \leqq LG \leqq 0.5$ and $DG \leqq 1.1 \times LG$ are satisfied, where LG (mm) is a length of opening of the recess as measured along the axis, and DG (mm) is a shortest distance between the opening of the recess and an innermost portion of the recess as measured along the front end surface of the insulator.

4. A plasma jet ignition plug according to claim 1, wherein the through hole and the center electrode are disposed such that as viewed on a section which contains the axis, an angle of 15° or greater is formed between a straight line orthogonal to the axis and a shortest line segment which connects the wall surface of the through hole and the front end portion of the center electrode.

5. A plasma jet ignition plug according to claim 1, wherein, the taper portion of the center electrode and a wall surface of the cavity form an angle of 10° or greater as viewed on a section which contains the axis.

6. A plasma jet ignition plug according to claim 1, wherein the ground electrode has a thickness of 0.3 mm to 1.0 mm inclusive.

7. A plasma jet ignition plug according to claim 1, wherein at least the front end portion of the center electrode is formed from tungsten or a tungsten alloy, and at least a portion of the ground electrode which forms the through hole is formed from an iridium alloy or a platinum alloy.

8. An ignition system comprising:

a plasma jet ignition plug comprising:

a tubular insulator having an axial hole extending therethrough in a direction of an axis;

a rodlike center electrode inserted into the axial hole in such a manner that a front end thereof is located rearward of a front end of the insulator with respect to the direction of the axis; and a ground electrode disposed frontward of the front end of the insulator;

wherein the insulator has a cavity which is defined by a wall surface of the axial hole and a front end surface of the center electrode and opens frontward, and the ground electrode has a through hole for establishing communication between the cavity and an ambient atmosphere; and wherein a front end portion of the center electrode is formed into a taper portion whose diameter reduces frontward with respect to the direction of the axis;

an outside diameter of a front end of the taper portion is smaller than a diameter of the through hole; and a diameter of the cavity is substantially constant with respect to the direction of the axis, and the diameter DC (mm) of the cavity and a length LC (mm) of the cavity along the direction of the axis satisfy a dimensional relation $0.5 \leqq LC/DC < 1.0$, and a plasma power supply for supplying power to the plasma jet ignition plug for generating plasma within the cavity, wherein the plasma power supply has an output of 10 mJ to 120 mJ inclusive.

9. An ignition system according to claim 8, further comprising discharge voltage application means for applying voltage across a gap formed between the center electrode and the ground electrode, wherein the plasma power supply is connected to an intermediate position between the plasma jet ignition plug and the discharge voltage application means, in parallel with the plasma jet ignition plug.

10. An ignition system according to claim 8, wherein when the through hole and the center electrode are disposed such that a wall surface of the through hole and the front end portion of the center electrode have a shortest distance SD1 (mm) therebetween, and the wall surface of the through hole and the center electrode have a shortest distance SD2 (mm) therebetween as measured along the wall surface of the axial hole, with $0.3 \leqq SD1 \leqq 0.7$, a dimensional relation $1.1 \times SD1 < SD2$ is satisfied, with $0.7 < SD1 \leqq 1.0$, a dimensional relation $1.2 \times SD1 < SD2$ is satisfied, with $1.0 < SD1 \leqq 1.2$, a dimensional relation $1.3 \times SD1 < SD2$ is satisfied, and with $1.2 < SD1 \leqq 1.3$, a dimensional relation $1.4 \times SD1 < SD2$ is satisfied.

11. An ignition system according to claim 8, wherein said plasma jet ignition plug further comprises:

an annular recess which is formed between a front end surface of the insulator and a surface of the ground electrode located on a side toward the insulator and opens toward the axis, wherein dimensional relations $0.05 \leqq LG \leqq 0.5$ and $DG \geqq 1.1 \times LG$ are satisfied, where LG (mm) is a length of opening of the recess as measured along the axis, and DG (mm) is a shortest distance between the opening of the recess and an innermost portion of the recess as measured along the front end surface of the insulator.

12. An ignition system according to claim 8, wherein the through hole and the center electrode are disposed such that as viewed on a section which contains the axis, an angle of 15° or greater is formed between a straight line orthogonal to the axis and a shortest line segment which connects the wall surface of the through hole and the front end portion of the center electrode.

13. An ignition system according to claim 8, wherein the taper portion of the center electrode and a wall surface of the cavity form an angle of 10° or greater as viewed on a section which contains the axis.

14. An ignition system according to claim 8, wherein the ground electrode has a thickness of 0.3 mm to 1.0 mm inclusive.

15. An ignition system according to claim 8, wherein at least the front end portion of the center electrode is formed from tungsten or a tungsten alloy, and at least a portion of the ground electrode which forms the through hole is formed from an iridium alloy or a platinum alloy.

* * * * *